US006352805B1

(12) United States Patent
Taylor et al.

(10) Patent No.: US 6,352,805 B1
(45) Date of Patent: Mar. 5, 2002

(54) PHOTOCROSSLINKABLE LATEX PROTECTIVE OVERCOAT FOR IMAGING ELEMENTS

(75) Inventors: Jeffrey F. Taylor, Mount Pleasant, PA (US); Kevin M. O'Connor, Webster, NY (US); Elmer C. Flood, Canandaigua, NY (US); Hwei-Ling Yau, Rochester, NY (US); Tienteh Chen, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/669,299

(22) Filed: Sep. 25, 2000

(51) Int. Cl.[7] ..... G03C 11/08; G03C 11/10; B41J 2/01

(52) U.S. Cl. ..... 430/14; 430/432; 430/532; 430/536; 430/961; 347/105

(58) Field of Search ..... 430/14, 532, 536, 430/961, 432; 347/105

(56) References Cited

U.S. PATENT DOCUMENTS

| | | | | |
|---|---|---|---|---|
| 4,092,173 A | | 5/1978 | Novak et al. | |
| 4,107,013 A | | 8/1978 | McGinniss et al. | 204/159.16 |
| 4,171,979 A | | 10/1979 | Novak et al. | |
| 4,186,069 A | | 1/1980 | Muzyczko et al. | 430/175 |
| 4,333,998 A | | 6/1982 | Leszyk | 430/12 |
| 4,353,980 A | * | 10/1982 | Helling et al. | 430/532 |
| 4,426,431 A | | 1/1984 | Harasta et al. | 430/14 |
| 4,587,169 A | | 5/1986 | Kistner | 428/213 |
| 4,619,949 A | | 10/1986 | Kistner | 522/170 |
| 5,178,996 A | * | 1/1993 | Kobayashi et al. | 430/532 |
| 5,695,920 A | | 12/1997 | Anderson et al. | 430/531 |
| 5,856,051 A | | 1/1999 | Yau et al. | 430/14 |

* cited by examiner

*Primary Examiner*—Richard L. Schilling
(74) *Attorney, Agent, or Firm*—Chris P. Konkol

(57) ABSTRACT

The present invention is directed to an imaged element that includes a support, at least image-receiving layer superposed on the support and a water-resistant protective overcoat overlying the image-receiving layer that is water-resistance. The present invention is also directed to a method of making a print by application of a UV-curable water-dispersible latex.

20 Claims, No Drawings

PHOTOCROSSLINKABLE LATEX PROTECTIVE OVERCOAT FOR IMAGING ELEMENTS

FIELD OF THE INVENTION

The present invention relates to imaged elements having a protective overcoat that resists fingerprints, common stains, and spills. In particular, an overcoat composition comprising a water-dispersible latex, a photopolymerizable monomer, and a photoinitiator is coated over an imaged element, including photographic elements and recording media.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. However, due to this same property, imaging elements with exposed gelatin-containing materials, no matter if they are formed on transparent or reflective media, have to be handled with extreme care so as not to be in contact with any aqueous solutions that may damage the images. Accidental spillage of common household solutions such as coffee, punch, or even plain water can damage imaging elements such as ink-jet, electrophotographic, or photographic prints.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. The latex is a resin having a glass transition temperature of from 30° C. to 70° C. The application of UV-polymerizable monomers and oligomers on processed image followed by radiation exposure to form crosslinked protective layer is described in U.S. Pat. Nos. 5 4,092,173, 4,171,979, 4,333,998 and 4,426,431. A drawback for both the solvent coating method and for the radiation cure method is the health and environmental concern of those chemicals or radiation to the coating operator.

There have been previous invention reports and patents that have described overcoat technology that would produce an overcoat for photographic systems. Aqueous based materials to obtain a spill resistant protective overcoat have been disclosed in which aqueous dispersed particles when coated and dried coalesce into a uniform coating. See, for example, U.S. Pat. No. 5,376,434 to Ogawa et al. and U.S. Pat. No. 6,087,051 to Shoji et al.

In addition to a uniform coating it would be advantageous to develop a level of crosslinking to build spill resistance and durability. One method for obtaining crosslinking is the use of molecules containing more than two reactive moieties (or multifunctional molecules) that can be cured when exposed to high temperatures or actinic radiation. Various patents describe the use of actinic radiation to obtain a crosslinkable overcoat for photographic packages. For example, U.S. Pat. No. 4,092,173 to Novak et al. discloses an overcoat technology using UV curable or actinic radiation for curing. This patent describes an acrylated urethane or polyfunctional acrylate ester which is applied to photographic elements for scratch resistance. U.S. Pat. No. 4,171,979 also to Novak et al. discloses an improvement upon U.S. Pat. No. 4,092,173 and includes repair of surface defects. U.S. Pat. No. 4,333,998 to Leszyk discloses an improvement upon U.S. Pat. 4,092,173 by the addition of a siloxycarbinol to the radiation curable composition.

U.S. Pat. No. 4,426,431 to Harasta et al. discloses a photocurable coating for restorative or protective treatment that uses a composition comprising a polymerizable epoxide, a polymerizable acrylic compound, catalyst, and a polymerizable organofunctional silane. The coating appears to involve a standard cationically initiated epoxy reaction. Other patents also disclose cationically initiated epoxy type systems. For example, EP 0 484 083 (1991) discloses triglycidyl ethers of trimethylol alkanes initiated with onium salts. U.S. Pat. Nos. 5 4,619,949 and 4,587,169 to Kistner disclose the use of an epoxy terminated silane and an aliphatic monomer epoxy resin, cationically initiated with an onium salt.

The UV-curable coatings described in the above mentioned U.S. Pat. No. 4619949, U.S. Pat. No. 4587169, and in EP 0 484 083 (1991), where an epoxy based liquid overcoat containing a photoinitiator is coated to the surface of a photographic image, are neat monomer systems that are 100% monomer and photoinitiator. Prior to cure, they are liquids that are difficult to handle and may create a health hazard if handled incorrectly.

U.S. Pat. No. 4,107,013 to McGiniss et al. describes a paint comprising a high molecular weight aqueous latex solution combined with a low molecular weight photocrosslinkable polymer. This composition has the advantage that heating of the coating to provide flow-out or leveling is eliminated. The low molecular weight crosslinker further provides flexibility and substrate adhesion while maintaining corrosion and wear resistance film characteristics. This patent does not mention coatings for an imaging element, but is focused on improving paint properties. Furthermore, McGiniss et al. does not describe the use of a loaded latex containing a photopolymerizable component.

U.S. Pat. No. 4,186,069 to Muzyczko et al. discloses a latex solution with an incorporated photopolymerizable component. The system is described as a 3 phase system prior to coating with an aqueous phase, a latex phase, and a light sensitive polymer phase. Upon coating, this system becomes a 2 phase system consisting of a latex phase and a light sensitive polymer phase. These systems are aimed at water developable lithographic printing plates.

A problem with UV-curing, as practiced in the prior art, is obtaining the desired combination of properties in the final coating and, at the same time, being able to commercially implement the application of the coating economically and efficiently. In the imaging field, high clarity, high gloss coatings that are water-resistant, oil resistant, and scratch resistant are desired. The coatings may need to be applied in a minilab setting, where worker safety and convenience are important.

SUMMARY OF THE INVENTION

The present invention is directed to a protective overcoat for an imaged element that provides water resistance, fingerprint resistance, and the like. It has been found that by UV-curing of a protective overcoat on an imaged element, improved performance is obtained with respect to durability, fingerprint resistance, and scratch resistance. In one embodiment of the present invention, a photographic print comprises a support, at least one gelatin-based imaged layer, and overlying the gelatin-based imaged layer, a protective overcoat that is the made from a composition comprising an aqueous dispersible latex and a photopolymerizable component system comprising a mixture of at least two components, a photoinitiator and a crosslinkable multifunctional monomer or macromonomer. The component system may include monofunctional monomers. The term "multifunctional monomer" is herein defined as a monomer having a plurality of ethylenically unsaturated sites for polymerization or copolymerization. This photopolymerizable component system is preferably loaded into the latex phase. More specifically, the photopolymerizable components are designed to be sufficiently hydrophobic that the photopolymerizable components absorb into the latex particles, yielding a monomer/initiator swollen particle. Alternatively, the photopolymerizable components may be water soluble and part of the aqueous phase. This coating composition may be applied to an imaged element, dried, and exposed to actinic radiation. The final cured overcoat will provide resistance to water and oil-based spills as well as resistance to fingerprints.

Another aspect of the invention provides for a method of forming a overcoat that is water-resistant over an imaged element.

DESCRIPTION OF THE PREFERRED EMBODIMENTS

The present invention provides a simple and inexpensive way to improve the water, stain and abrasion resistance of processed photographic elements. In accordance with the invention, the protective overcoat is applied over the photographic element after exposure and processing. In particular, a overcoat formulation according to the present invention is applied to the emulsion side of photographic products, particularly photographic prints, which may encounter frequent handling and abuse by end users.

By the term "water-resistant" is meant herein that, after ordinary image processing, the imaged element does not imbibe water or has a protective overcoat that prevents or minimizes water-based stains from discoloring the imaged side of the imaged element.

As indicated above, the invention uses an aqueous latex solution and a photopolymerizable component system. The photopolymerizable component system is preferably in the form of a multifunctional monomer and photoinitiator that will be absorbed or loaded into the latex phase. This two-phase suspension, an aqueous phase and a loaded latex phase, is then coated onto an imaged element such as a photographic print and dried, forming a uniform coating. Upon exposure to actinic radiation, the photopolymerizable component system cures, resulting in an increase in spill and fingerprint resistance. Alternatively, water soluble photopolymerizable monomer and a water soluble photoinitiator may be employed in the coating composition.

In a preferred embodiment of the invention, the overcoat composition applied to the imaged element comprises a dry laydown of at least 0.54 g/m$^2$ (50 mg/ft$^2$) made from an overcoat formulation comprising water-dispersible latex particles in the form of particles have an average particle size of 10 to 250 nm, a photopolymerizable component system comprising copolymerizable compatible monomers, at least one of which monomers is a multifunctional monomer having more than one polymerizable ethylenic unsaturation, and a UV-sensitive initiator, wherein the Tg of the coated composition comprising the latex particles and the photopolymerizable component system prior to crosslinking is −60 to 60° C.

The monomers used herein to comprise the photopolymerizable component system may be any molecule that may be polymerized by a photoinitiator and that will sufficiently load into the particles of the latex suspension. Preferable monomers would be multifunctional acrylates and mixtures thereof with any vinyl containing compound that can be initiated by a free radical source such as a benzophenone, benzoin or benzoin ether compound. Multifunctional acrylates are preferred. The term "monomer" includes macromonomers. For example, an epoxy containing multifunctional compound, including oligomers or prepolymers, may be used which can be ionically initiated using a cation generating source such as an onium ion containing compound.

Examples of multifunctional monomers include monomers such as 1,3-butylene glycol dimethacrylate; ethylene glycol diacrylate; ethylene glycol dimethacrylate; Bisphenol-A-dimethacrylate; diethylene glycol dimethacrylate; pentaerythritol triacrylate; pentaerythritol tetraacrylate; triethylene glycol dimethacrylate; trimethylol propane trimethacrylate; trimethylene glycol dimethacrylate; trimethylol propane triacrylate; tetraethylene glycol diacrylate; ethoxylated Bisphenol-A-dimethacrylate; pentaerythritol tetramethacrylate; allyl acrylate; allyl crotonate; allyl methacrylate; diallyl acrylate; diallyl fumarate; diallyl malate; diallyl maleate; diallyl methalate; diallyl-oxyethyl methacrylate; melamine acrylate; triallyl-5-triazine; vinyl trialloxy silane; triallyl cyanurate; 1,6-hexanediol diacrylate; divinyl benzene; diallyl amine; trimethylol propane dimethyl ether; diallyl malate methacrylate; and dihydroxyethylphthalate. The preferred multifunctional monomer is pentaerythritol tetraacrylate.

The photopolymerizable monomer composition could range between 20 to 300 wt. % with respect to the hydrophobic polymer, and would preferably range between 50 to 200 wt. %, with respect to the hydrophobic polymer (1:2 to 2:1 weight ratio). The photoinitiator composition could range between 1 to 25 wt. % with respect to the total photopolymerizable component system, preferably between 5 to 15 wt. %.

The dispersions of hydrophobic polymers used in this invention are latexes or hydrophobic polymers of any composition that can be stabilized in a water-based medium. Such hydrophobic polymers are generally classified as either condensation polymer or addition polymers. Condensation polymers include, for example, polyesters, polyamides, polyimides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitrites, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, suspension polymerization, dispersion polymerization, and other polymerization methods known in the art of polymerization. The selection of water-dispersible particles to be used in the overcoat is based on the material properties one wishes to have as the protective overcoat in addition to water resistance. Optionally, the latex particles in the coating composition in accordance with the invention can also contain suitable crosslinking agents for crosslinking the water-dispersible polymer during preparation.

Preferred latex polymers are polymers obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

To form the latex, the latex monomer solution may be dispersed in water using techniques well known in the art, including emulsion polymerization or solution polymerization technique. Emulsion polymerization is preferred. Emulsion polymerization is well known in the art and is described, for example, in J. L. Gardon, "Emulsion Polymerization", Chapter 6 in "Polymerization Processes" edited by C. E. Schildknecht and I. Skeist, published by Wiley and Sons, Inc. New York, 1977. Examples of the chemical initiators which may be used include a thermally decomposable initiator, for example, a persulfate (such as ammonium persulfate, potassium persulfate, sodium persulfate), hydrogen peroxide, 4,4'-azobis(4-cyanovaleric acid), and redox initiators such as hydrogen peroxide-iron (II) salt, potassium persulfate-sodium hydrogensulfate, potassium persulfate-sodium metabisulfite, potassium persulfate-sodium hydrogen bisulfite, cerium salt-alcohol, etc. Emulsifiers which may be used in the emulsion polymerization include soap, a sulfonate(for example, sodium N-methyl-N-oleoyltaurate, sodium dodecylbenzene sulfonate alpha-olefin sulfonate, diphenyloxide disulfonate, naphthalene sulfonate, sulfosuccinates and sulfosuccinamates, polyether sulfonate, alkyl polyether sulfonate, alkylarylpolyether sulfonate, etc.), a sulfate (for example, sodium dodecyl sulfate), a phosphate (for example, nonylphenol ethoxylate phosphate, linear alcohol alkoxylate phosphate, alkylphenol ethoxylate phosphate, phenol ethoxylate), a cationic compound (for example, cetyl trimethylammonium bromide, hexadecyl trimethylammonium bromide, etc.), an amphoteric compound and a high molecular weight protective colloid(for example, polyvinyl alcohol, polyacrylic acid, gelatin, etc.). Specific examples and functions of the emulsifiers are described in . J. L. Gardon, "Emulsion Polymerization", Chapter 6 in "Polymerization Processes" edited by C. E. Schildknecht and I. Skeist, published by Wiley and Sons, Inc., New York, 1977 and references contained therein. Common chain transfer agents or mixtures thereof known in the art, such as alkylmercaptans, can be used to control the polymer molecular weight.

In accordance with the invention, an imaged element such as a photographic element is provided with a protective overcoat having the above described composition. The protective overcoat may be applied after development, in the case of a photographic print, or after printing, in the case of an ink-jet print. The application, drying, and curing of the protective overcoat on an imaged element can be accomplished, for example, by any of the methods described in commonly assigned U.S. Pat. No. 5,984,539, herein incorporated by reference in its entirety. A preferred method of application, drying, and curing is shown in FIG. 16A of the latter patent. As indicated above, the properties of the protective overcoat on the imaged element are enhanced by the crosslinking of the photopolymerizable component system in the overcoat by means of actinic radiation.

In one embodiment, a photographic element according to the present invention comprises: (a) a support; (b) at least one silver-halide emulsion layer superposed on a side of said support; and (c) overlying the silver emulsion layer, a protective overcoat having a dry laydown of at least 0.54 $g/m^2$ (50 $mg/ft^2$) made from an overcoat formulation comprising 0.45 to 6.0 $g/m^2$ (about 45 to 600 $mg/ft^2$) dry laydown of water-dispersible latex particles in the form of particles have an average particle size of 10 to 250 nm, and a photopolymerizable component system comprising 20 to 300 weight percent, with respect to the hydrophobic polymer, of copolymerizable compatible monomers, at least one of which monomers is a multifunctional monomer having more than one polymerizable ethylenic unsaturation, and 1 to 25 weight percent, with respect to the component, of a UV-sensitive initiator, wherein the Tg of the coated composition comprising the latex particles and the photopolymerizable component system prior to crosslinking is −60 to 60° C., preferably −20 to 30° C.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol® OT), and alkylcarboxylate salts such as sodium decanoate.

Matte particles well known in the art may also be used in the coating composition of the invention, such matting agents have been described in *Research Disclosure* No. 308119, published Dec. 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfonic acid, active methylene, amino, amide, allyl, and the like.

In order to reduce the sliding friction of the imaged elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in *Research Disclosure* No. 308119, published Dec. 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874,205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating layers of the imaging element of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published Dec. 1989, pages 1007 to 1008. Preferably, a commercial embodiment involve simultaneous co-extrusion.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Imaged elements protected in accordance with this invention may be photographic elements that differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (Dec., 1978). Because of the amount of handling that can occur with paper prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure*, Item 34390, Nov. 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a protective overcoat having the above described composition overlying the silver halide emulsion layer superposed on a support. The photographic element, after image-wise exposure, is developed in an alkaline developer solution having a pH greater than 7, preferably greater than 8, more preferably greater than 9. The protective overcoat may be applied after development. The application, drying, and curing of the protective overcoat on an imaged element can be accomplished, for example, by any of the methods described in commonly assigned U.S. Pat. No. 5,984,539, herein incorporated by reference in its entirety. A preferred method of application, drying, and curing is shown in FIG. 16A of the latter patent.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention also applies to imaged recording elements in which the images, for example, are derived from a pixel-based picture made with a digital still camera. The image can be formed in one or more recording layers, for example as produced using ink-jet printing or electrophotographic printing. Ink-jet printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5563634 of Masahiro et al. (Seiko Epson).

The carrier for the ink-jet inks may be comprised solely of water or can be predominantly water mixed with water soluble solvents such as polyhydric alcohols or can be predominantly organic materials such as polyhydric alcohols. The dyes used in such compositions are typically water-soluble direct or acid type dyes. Such liquid ink compositions have been described extensively in the prior art, including, for example, U.S. Pat. No. 4,781,758.

In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5, 560,770 of Yatake (Seiko Epson), and U.S. Pat. No. 5,738,716 of Santilli et al. (Eastman Kodak).

Ink-jet media or receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, waterfastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The use of the present invention in the context of typical recording elements will now be described in more detail. Any support or substrate may be used in a recording element, for example, plain or calendered paper, paper coated with protective polyolefin layers, polymeric films such as poly(ethylene terephthalate), poly(ethylene naphthalate), poly(1,4-cyclohexane dimethylene terephthalate), polyvinyl chloride, polyimide, polycarbonate, polystyrene, or cellulose esters. In particular, polyethylene-coated paper or poly(ethylene terephthalate) is preferred.

The support is suitably of a thickness of from about 50 to about 800 $\mu$m, preferably from about 75 to 500 $\mu$m. Antioxidants, antistatic agents, plasticizers, dyes, pigments and other known additives may be incorporated into the support, if desired.

In order to improve the adhesion of the image-recording layer to the support, the surface of the support may be optionally subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as acrylates, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable. antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

Preferably, the support in a recording element is coated with an image forming layer or layers of materials capable of absorbing the carrier and/or dyes in the ink. The thickness of this layer is typically from 5 to 50 micrometers (μm). The material may include a hydrophilic polymer, including naturally-occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers. Poly(vinyl alcohol) and its derivatives are preferred hydrophilic absorbing materials for use in ink receptive coatings. This layer may also comprise a microporous material. Preferred microporous materials are silica, alumina, or hydrated alumina, boehmite, mica, montmorillonite, kaolite,talc, vermiculite, zeolites, calcium silicate, titanium oxide, barium sulfate, and the like, optionally in combination with a polymeric binder. See, for example, U.S. Pat. No. 5,605,750, incorporated by reference. Many known microporous materials may be employed, including for example, those described in U.S. Pat. Nos. 5.032,450; 5,035,886, 5,071,645, and 5,14,438.

For higher quality ink-jet media, a separate upper image-forming layer may be formed above a carrier-absorbing layer. Accordingly, when the ink is ejected from the nozzle of the ink-jet printer in the form of individual droplets, the droplets pass through the upper layer where most of the dyes or pigments in the ink are retained or mordanted while the remaining dyes/pigments and the carrier portion of the ink pass freely through the upper layer to the carrier-absorbing layer where they are rapidly absorbed, for example, by a hydrophilic polymer and/or microporous material. In this manner, large volumes of ink are quickly absorbed by the recording elements, giving rise to high quality recorded images having excellent optical density and good color gamut.

Image-forming layers in recording elements can also incorporate various known additives, including matting agents such as titanium dioxide, zinc oxide, silica, and polymeric beads such as polystyrene beads for the purposes of contributing to the non-blocking characteristics of the recording elements and to control the smudge resistance thereof; surfactants for improving the aging behavior of the ink-absorbing resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; dye-fixing agents; viscosity modifiers; waterproofing agents; dispersing agents; UV absorbing agents; mordants, and the like.

If desired, in addition to a coating according to the present invention, the recording element can be further coated with an ink-permeable, anti-tack, ink receptive coating, such as, for example, a hydrophilic cellulose derivative such as methyl cellulose, ethyl cellulose, hydroxyethyl cellulose, hydroxypropyl cellulose, sodium carboxymethyl cellulose, calcium carboxymethyl cellulose, methyethyl cellulose, methylhydroxyethyl cellulose, hydroxypropylmethyl cellulose, hydroxybutylmethyl cellulose, ethylhydroxyethyl cellulose, sodium carboxymethylhydroxyethyl cellulose, carboxymethylethyl cellulose, hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide; as well as hydroxyethyl cellulose grafted with alkyl C12–C14 chains.

The present invention is illustrated by the following examples. Unless otherwise indicated, the molecular weights herein are weight average molecular weights, as determined by size exclusion chromatography described below.

EXAMPLE 1

This Example illustrates the preparation of coating composition and its application to a photographic element.

Preparation of Photopolymerizable Component System

In a brown glass bottle, a mixture of 9 parts pentaerythritol tetra-acrylate (from Sartomer Chem. Co.) and one part by weight of 2-hydroxy-2-methyl propiophenone (from Aldrich Chemical Co.) was mixed.

Preparation of Latex

A Butyl AcrylateNinylidene Chloride/Itaconic Acid (15/83/2) terpolymer latex was prepared as follows. To a 400 ml glass bottle, added in order: (1) 222.5g of demineralized water, degassed with nitrogen for 10 minutes, (2) 1.35g of Triton™-770, (3) 1.64g of itaconic acid, (4) 12.33g of butyl acrylate, (5) 68.25g of vinylidene chloride, (6) 0.204g of potassium metabisulfate, and (7) 0.102g sodium persulfate. The bottle was sealed and put in a tumbler bath at 30° C. for 16–20 hours. The polymerized mixture was stripped under vacuum for 15 minutes at room temperature to remove residual volatile monomers. Glass transition temperature was 5° C. as measured by DSC. The final solution were diluted to 10 wt. % solids.

The coating compositions in Table 1 below were prepared in brown glass bottles. Each solution was stirred with a magnetic stir bar for 24 hours at room temperature. The solutions were prepared by weighing out the latex solution, then adding deionized water, surfactant (a 10 wt. % solution of Olin ® 10G (Olin-Matheson) and then the photopolymerizable component in the amounts given in Table 1.

TABLE 1

| Sample No. | Latex solution (grams) | Deionized water (grams) | Surfactant (grams) | Photopolymerizable Components (grams) |
|---|---|---|---|---|
| 1a | 2.46 | 12.55 | 0.11 | 0 |
| 1b | 2.46 | 12.55 | 0.11 | 0.1 |
| 1c | 2.46 | 12.55 | 0.11 | 0.2 |
| 1d | 2.46 | 12.55 | 0.11 | 0.25 |
| 1e | 2.46 | 12.55 | 0.11 | 0.5 |
| 1f | 2.46 | 12.55 | 0.11 | 1.5 |

A roll of color paper (Eastman Kodak Edge®5) was processed by the standard methods. The above compositions were coated using a wire rod coating apparatus. The aim wet thickness was 40.6 μm. The samples were dried in a standard convection oven for 5 minutes at 60° C. The samples were then stored at room conditions for approximately 2 hours. A portion of the sample was kept for analysis, the rest of the sample was exposed to ultraviolet light with a dosage of 700 millijoules/cm$^2$ using a Fusion System® UV curing apparatus equipped with a medium pressure mercury arc lamp. The coating performance was assessed by the following tests.

Test for Water Resistance

Water resistance was assessed as follows. Ponceau red dye is known to stain gelatin through ionic interaction. Ponceau red dye solution was prepared by dissolving 1 gram of dye in 1000 grams mixture of acetic acid and water (5 parts: 95 parts). A drop of the dye solution was placed on the surface of the photographic sample. After 10 minutes, the sample is wiped clean using a cotton cloth. Samples showing sufficient water protection will show no red mark; however, samples with no protective overcoat or insufficient protection will show a dense red stain. To differentiate further the difference in the resistance to the Ponceau red, the following scale was used.

A No mark or red stain. A ranking of "A" is most desirable.

B Some lines or speckles of red are visible.

C Outline of spot visible.

D Full red spot.

Test for Fingerprint Resistance

Thermaderm, a specially formulated mixture (see preparation below) to mimic grease on human skin was prepared as follows.

| | Amount |
|---|---|
| Non-aqueous phase | |
| Corn oil | 78.96 grams |
| Mineral oil | 25.26 grams |
| Glycerin | 52.64 grams |
| Stearyl alcohol | 15.79 grams |
| Oleic acid | 63.16 grams |
| Sorbitan monooleate | 21.05 grams |
| Cetyl palmitate | 6.32 grams |
| Oleyl alcohol | 6.32 grams |
| Stearic acid | 31.58 grams |
| Lexemul ® AR Glyceryl Stearate (Inolex Chemical Co., Philadelphia, PA 19148) | 47.36 grams |
| Cholesterol | 9.47 grams |
| Methylparaben | 4.21 grams |
| Butyl paraben | 3.16 grams |
| Butylated hydroxytoluene | 0.21 grams |
| Butylated hydroxyanisole | 0.21 grams |
| Vitamin E acetate | 0.13 grams |
| Cetyl alcohol | 15.79 grams |
| Squalene | 15.79 grams |
| Aqueous Phase | |
| Pegosperse ® 1750 MS-K Surfactant | 31.58 grams |
| Distilled water | 571.01 grams |

Ingredients were added in the order listed. The corn oil was carefully heated using a warm water bath to aid in the dissolution of the non-aqueous phase. The aqueous phase was warmed to aid in the dissolution of the Pegosperse®, an ethoxylated fatty acid sold by Glyco Chemicals, Inc. The aqueous phase was quickly added to the non-aqueous phase with vigorous agitation. The resultant suspension was then partially emulsified with an air powered Polytron® mixer for approximately 5 minutes. Complete emulsification was accomplished by processing through a microfluidizer. After preparation, the material was stored in a tightly sealed container and kept frozen, removing a small quantity as needed for the tests.

The thermaderm preparation was applied to the surface of the protective overcoat by (i) smearing with a finger approximately 1 mg of thermaderm over an area of 1 $cm^2$, and (ii) melting the mixture and then placing a 1 ml drop on the surface. The two different methods were used to establish the difference between a finger print and a spill. The tests will be referred to in the report as the "thermaderm fingerprint test" and the "thermaderm drop test," respectively. The thermaderm fingerprints were left for 24 hours at room condition (often 70° F./50%RH) and then wiped with a cotton cloth to clean up the surface. The thermaderm drop samples were left for 10 minutes and then wiped with a cotton cloth to clean up the surface. The tests was ranked according to the following phenomenon.

A No mark or fingerprints or marks were observed.

B Very mild/faint fingerprints or marks on the protective overcoat layer was observed.

C Very obvious fingerprint mark by thermaderm on the protective overcoat was observed.

D Protective overcoat layer was removed on wiping.

A ranking of "A" is most desirable, a ranking of "B" is acceptable, and a ranking of "C" and "D" is considered not acceptable.

The results of the analysis of the tests on the samples in Table 1 are given in Table 2:

TABLE 2

| | Uncured Samples | | | Cured Samples | | |
|---|---|---|---|---|---|---|
| Sample No. | Thermaderm Fingerprint | Thermaderm Spot | Ponceau Red | Thermaderm Fingerprint | Thermaderm Spot | Ponceau Red |
| 1a | C | C | A | B | C | A |
| 1b | C | C | A | B | B | A |
| 1c | C | B | A | B | B | A |
| 1d | B | B | A | A | A | A |
| 1e | NA* | NA | NA | B | A | A |
| 1f | C | NA | A | C | A | A |

"NA" indicates no data available.

From the above information it is evident that the presence of the cured photopolymerizable component in the latex coating on the photographic print resulted in significantly increased fingerprint and spot resistance. The best example (Example 1d) corresponds to a ratio of photopolymerizable material to latex of about 1:1.

EXAMPLE 2

This Example illustrates a method of determining the location of the photopolymerizable component in the coating composition. To determine if the photopolymerizable components are present in the aqueous phase or if it has loaded into the latex phase, a differential scanning calorimetry (DSC) experiment was carried out. One way to determine if the photopolymerizable components are loaded into the latex phase is to examine the glass transition temperature of the latex. When a low molecular weight component, such as the photopolymerizable monomer or photoinitiator is loaded into the polymer latex, that glass transition temperature is decreased due to plasticization. If loading did not take place, then the latex will not be plasticized, and the glass transition temperature will remain unchanged. Additionally, the glass transition temperature can be used to determine if the incorporated monomer has been crosslinked. If crosslinking occurs, the monomer will quickly increase in molecular weight and the glass transition temperature will rise again.

Samples were prepared as described earlier with compositions as illustrated in Table 1 above. These solutions were coated onto a glass microscope slide. After drying in a vacuum oven for 1 hour at room temperature, half of the scraped off and placed in a DSC sample pan. The other half of the sample was exposed to ultraviolet light in the same fashion as described earlier. The final cured samples were then scraped off and placed in A DSC sample pan. The glass transition temperature was measured using a TA Instruments Model 2910® DSC. The sample was heated at a rate of 10° C./minute. The glass transition temperature was taken as the half height of the observed step function. The results are shown in Table 3 below.

TABLE 3

| Sample | Tg (uncured) ° C. | Tg (cured) ° C. |
|---|---|---|
| 1a | 5 | 5 |
| 1b | −9 | 11 |
| 1c | −17 | 12 |
| 1d | −20 | 10 |
| 1e | −18 | 12 |

Referring to Table 3, the result that the Tg of the cured coatings is higher than the mixture before curing is indicative of successful curing. Based on the results in the Table 3, the glass transition temperature of the dried-down coating composition prior to UV curing decreases with increasing amounts of photopolymerizable component system which is indicative of efficient loading of the component system into the latex. The Tg would not change if the monomer was not at least partially miscible with the latex polymer. The loading of the latex, by lowering the Tg, aids in the formation of a continuous film on drying. Preferably, loading occurs to the extent that equal amounts of monomer and polymer are in the loaded polymer. Preferably, the monomer is miscible in the latex at least to a ratio of 1:1 by weight.

EXAMPLE 3

This Example illustrates a water soluble photopolymerizable component system for use in the present invention.

Preparation of Photopolymerizable Components

In a brown glass bottle, a mixture of 9 parts CD9038® monomer, a highly ethoxylated bisphenol A diacrylate ester (Sartomer Chem. Co.) and 1 part by weight of Irgacure® 2959 (a benzoin photoinitiator from Ciba Geigy) were mixed.

Preparation of Latex Preparation

A polymer composition 15 wt. % butyl acrylate, 83 wt. % vinylidene chloride, and 2 wt. % of itaconic acid was prepared as in Example 1 above. The final solution was diluted to 10 wt. % solids.

The following compositions in Table 4 were prepared in brown glass bottles. Each solution was stirred with a magnetic stir bar for 24 hours at room temperature. The solutions were prepared by weighing out the latex solution, adding the surfactant FT-248 (Bayer Co.), and then the photopolymerizable components in the amounts given in Table 4.

TABLE 4

| Sample No. | Latex Solution (grams) | Surfactant (grams) | Photopolymerizable Component (grams) |
|---|---|---|---|
| 3a | 15 | 0.11 | 0 |
| 3b | 15 | 0.11 | 0.04 |
| 3c | 15 | 0.11 | 0.08 |
| 3d | 15 | 0.11 | 0.11 |
| 3e | 15 | 0.11 | 0.15 |
| 3f | 15 | 0.11 | 0.19 |
| 3g | 15 | 0.11 | 0.23 |
| 3h | 15 | 0.11 | 0.26 |
| 3i | 15 | 0.11 | 0.30 |
| 3j | 15 | 0.11 | 0.34 |

A roll of color paper (Eastman Kodak Edge® 5) was processed by the standard methods. The above solutions were coated using a wire rod coating apparatus. The aim wet thickness was 40.6 $\mu$m. The samples were dried in a standard convection oven for 5 minutes at 60° C. The samples were stored at room conditions for approximately 2 hours. A portion of the sample was kept for analysis, the rest of the sample was exposed to ultraviolet light with a dosage of 700 millijoules/cm2 using a Fusion System® UV curing apparatus equipped with a medium pressure mercury arc lamp. The samples were assessed using the tests described above. The results are given in Table 5 below.

TABLE 5

| | Uncured Samples | | | Cured Samples | | |
|---|---|---|---|---|---|---|
| Sample No. | Thermaderm Fingerprint | Thermaderm Spot | Ponceau Red | Thermaderm Fingerprint | Thermaderm Spot | Ponceau Red |
| 3a | C | C | A | C | B | A |
| 3b | C | C | A | B | B | A |
| 3c | C | C | A | B | B | A |
| 3d | C | C | A | B | B | A |
| 3e | C | C | A | B | B | A |
| 3f | C | C | A | C | B | A |
| 3g | C | D | A | B | A | A |
| 3h | C | B | A | B | A | A |

From the above results, it is evident that the presence of the cured photopolymerizable components in the aqueous phase gives an increase in fingerprint resistance. However, compared to Example 1 (in which the latex was loaded with monomer), where the photopolymerizable component is incorporated into the latex phase, the increase in performance (especially for fingerprint resistance) is not as high. However, the ratio of monomer to polymer is much lower than in Example 1. The higher amounts of monomer, in Samples 3i and 3j, did not coat properly because of the immiscibility of the monomer in water. Thus, loading of the monomer into the latex prior to melt preparation is advantageous because it allows incorporation of higher amounts of monomer.

The invention has been described in detail with particular reference to certain preferred embodiments thereof, but it will be understood that variations and modifications can be effected within the spirit and scope of the invention.

What is claimed is:

1. An imaged element having a water-resistant protective overcoat thereon, comprising the following:

(a) a support and at least one image-receiving layer carrying a dye or pigment-based pictorial image; and (b) overlying the at least one image-receiving layer, a protective overcoat having a laydown of at least 0.54 $g/m^2$ (50 $mg/ft^2$) of a crosslinked coating composition comprising the reaction product of the following components:

a) water-dispersible latex particles comprising a film-forming hydrophobic polymer which particles have an average particle size of from 10 to 250 nm;

b) a photopolymerizable component system comprising 20 to 300 weight percent, with respect to the hydrophobic polymer, of copolymerizable compatible monomers, at least one of which monomers is a multifunctional monomer having more than one polymerizable ethylenic unsaturation, and 1 to 25 weight percent, with respect to the photopolymerizable component system, of an ultraviolet light-sensitive initiator;

wherein the Tg of the coated composition comprising the latex particles and the photopolymerizable component system prior to crosslinking is −60 to 60° C.

2. The imaged element of claim 1 wherein the multifunctional monomer is a multifunctional acrylate.

3. The imaged element of claim 1 wherein the multifunctional monomer is an epoxy containing oligomer or prepolymer that can be ionically initiated using a cation generating source.

4. The imaged element of claim 1 wherein the multifunctional monomer is selected from the group consisting of 1,3-butylene glycol dimethacrylate; ethylene glycol diacrylate; ethylene glycol dimethacrylate; Bisphenol-A-dimethacrylate; diethylene glycol dimethacrylate; pentaerythritol triacrylate; pentaerythritol tetraacrylate; triethylene glycol dimethacrylate; trimethylol propane trimethacrylate; trimethylene glycol dimethacrylate; trimethylol propane triacrylate; tetraethylene glycol diacrylate; ethoxylated Bisphenol-A-dimethacrylate; pentaerythritol tetramethacrylate; allyl acrylate; allyl crotonate; allyl methacrylate; diallyl acrylate; diallyl fumarate; diallyl malate; diallyl maleate; diallyl methalate; diallyl-oxyethyl methacrylate; melamine acrylate; triallyl-5-triazine; vinyl trialloxy silane; triallyl cyanurate; 1,6-hexanediol diacrylate; divinyl benzene; diallyl amine; trimethylol propane dimethyl ether; diallyl malate methacrylate; and dihydroxyethylphthalate.

5. The imaged element of claim 4 wherein the multifunctional monomer is pentaerythritol tetraacrylate.

6. The imaged element of claim 1 wherein said aqueous water-dispersible latex is principally a polymer selected from the group consisting of polyesters, polyamides, polyurethanes, polyureas, polyethers, polycarbonates, polyacid anhydrides, polymers derived from vinyl ethers, vinyl heterocyclic compounds, styrenes, olefins, halogenated olefins, unsaturated acids and esters thereof, unsaturated nitriles, vinyl alcohols, acrylamides and methacrylamides, and vinyl ketones, poly(epoxides) and copolymers formed from various combinations of the corresponding monomers, and combinations thereof.

7. The imaged element of claim 1 wherein said aqueous water-dispersible latex is comprises a polymer that is the reaction product of a mixture of monomers comprising one or more monomers selected from the group consisting of alkyl esters of acrylic or methacrylic acid, hydroxyalkyl esters of the same acids, the nitrile and amides of the same acids, vinyl acetate, vinyl propionate, vinylidene chloride, vinyl chloride, and vinyl aromatic compounds.

8. The imaged element of claim 1 wherein said initiator is selected from the group consisting of benzophenone, benzoin, and benzoin ether compounds.

9. The imaged element of claim 1, wherein the image layer is based on ink-jet.

10. The imaged element of claim 1 wherein the photopolymerizable component system is substantially loaded into the latex particles.

11. The imaged element of claim 1 wherein the support comprises polymeric films, papers or glass.

12. The imaged element of claim 1 wherein the overcoat composition further comprises UV absorbers, surfactants, emulsifiers, coating aids, lubricants, matte particles, rheology modifiers, crosslinking agents, antifoggants, inorganic fillers, pigments, magnetic particles and/or biocides.

13. A photographic element having a water-resistant protective overcoat thereon, the protective overcoat comprising:

(a) a support;

(b) at least one silver-halide-derived imaged layer superposed on a side of said support; and (c) overlying the silver-halide-derived image layer, a protective over coat having a laydown of at least 0.54 $g/m^2$ (50 $mg/ft^2$) of a crosslinked coating composition comprising the reaction product of the following components:

i) 0.45 to 6.0 $g/m^2$ (about 45 to 600 $mg/ft^2$) dry laydown of water-dispersible latex particles comprising a film-forming hydrophobic polymer which particles have an average particle size of from 10 to 250 nm; and ii) a photopolymerizable component system comprising 20 to 300 weight percent, with respect to the hydrophobic polymer, of copolymerizable compatible monomers, at least one of which monomers is a multifunctional monomer having more than one polymerizable ethylenic unsaturation, and 1 to 25 weight percent, with respect to the photopolymerizable component system, of an ultraviolet light-sensitive initiator;

wherein the Tg of the coated composition comprising the latex particles and the photopolymerizable component system prior to crosslinking is −60 to 60° C.

14. A method of making an imaged element comprising:

(a) providing an imaging element comprising a support and at least one imaging layer superposed on a side of said support;

(b) forming an image in the at least one imaging layer;

(c) applying a protective overcoat having a laydown of at least 0.54 $g/m^2$ (50 $mg/ft^2$) made from a coating composition comprising (i) water-dispersible latex particles comprising a film-forming hydrophobic polymer which particles have an average particle size of from 10 to 250 nm; (ii) a photopolymerizable component system comprising 20 to 300 weight percent, with respect to the hydrophobic polymer, of copolymerizable compatible monomers, at least one of which monomers is a multifunctional monomer having more than one polymerizable ethylenic unsaturation, and (iii) 1 to 25 weight percent, with respect to the component, of a ultraviolet light-sensitive initiator; wherein the Tg of the coated composition comprising the latex particles and the photopolymerizable component system prior to crosslinking is −60 to 60° C.; and (d) curing the coating composition by the use of UV radiation to crosslink the monomers.

15. The method of claim 14 wherein the imaging element is a photographic print and the image is formed in a developer solution having a pH greater than 7.

16. The method of claim 14 wherein the wherein the multifunctional monomer is a multifunctional acrylate.

17. The method of claim 14 wherein said aqueous water-dispersible latex is principally a polymer selected from the group consisting of polyesters, polyamides, polyimides, polyurethanes, polyureas, polyethers, polycarbonates, poly-acid anhydrides, polymers derived from vinyl ethers, vinyl heterocyclic compounds, styrenes, olefins, halogenated olefins, unsaturated acids and esters thereof, unsaturated nitriles, vinyl alcohols, acrylamides and methacrylamides, and vinyl ketones, poly(epoxides) and copolymers formed from various combinations of the corresponding monomers, and combinations thereof.

18. The method of claim 12 wherein said aqueous water-dispersible latex is principally a polymer that is the reaction product of a mixture of monomers comprising one or more monomers selected from the group consisting of alkyl esters of acrylic or methacrylic acid, hydroxyalkyl esters of the same acids, the nitrile and amides of the same acids, vinyl acetate, vinyl propionate, vinylidene chloride, vinyl chloride, and vinyl aromatic compounds.

19. The method of claim 14 wherein said initiator is selected from the group consisting of benzophenone, benzoin, and benzoin ether compounds.

20. The method of claim 14 wherein the image layer is based on ink-jet.

* * * * *